US005103159A

United States Patent [19]

Breugnot et al.

[11] Patent Number: 5,103,159

[45] Date of Patent: Apr. 7, 1992

[54] CURRENT SOURCE WITH LOW TEMPERATURE COEFFICIENT

[75] Inventors: Frédéric Breugnot, Gournay S/Marne; Franck Edme, Aix en Provence, both of France

[73] Assignee: SGS-Thomson Microelectronics S.A., Gentilly, France

[21] Appl. No.: 600,309

[22] Filed: Oct. 19, 1990

[30] Foreign Application Priority Data

Oct. 20, 1989 [FR] France ..... 89 13757
Oct. 20, 1989 [FR] France ..... 89 13758

[51] Int. Cl.[5] ..... G05F 3/16

[52] U.S. Cl. ..... 323/315; 323/314; 323/907

[58] Field of Search ..... 323/312, 313, 314, 315, 323/316, 317, 907

[56] References Cited

U.S. PATENT DOCUMENTS

| | | | |
|---|---|---|---|
| 4,325,018 | 4/1982 | Schade, Jr. | 323/313 |
| 4,443,753 | 4/1984 | McGlinchey | 323/313 |
| 4,525,663 | 6/1985 | Henry | 323/315 |
| 4,849,684 | 7/1989 | Sonntag et al. | 323/907 |
| 4,935,690 | 6/1990 | Yan | 323/907 |

FOREIGN PATENT DOCUMENTS

| | | |
|---|---|---|
| 140677 | 5/1985 | European Pat. Off. . |
| 2652672 | 4/1991 | France . |
| 59-52321 | 3/1984 | Japan . |
| 2070820 | 9/1981 | United Kingdom . |

OTHER PUBLICATIONS

IEEE Journal of Solid State Circuits, vol. SC-8, No. 3, Jun. 1973, pp. 222-226, K. E. Kuijk, "A Precision Reference Voltage Source".

*Primary Examiner*—Jeffrey Sterrett
*Attorney, Agent, or Firm*—Richards, Medlock & Andrews

[57] ABSTRACT

The disclosure concerns integrated circuits. More particularly, a method is disclosed for making a constant current source, in these circuits, that is stable as a function of the temperature and the supply voltage of the integrated circuit. It is proposed to make a stable current source in using two parallel-mounted transistors, one of which is controlled by a bandgap type of reference voltage while the other is controlled by a Wilson mirror. The addition of the currents of the two transistors gives a current that is far more stable as a function of temperature than the individual currents in each of the transistors.

14 Claims, 2 Drawing Sheets

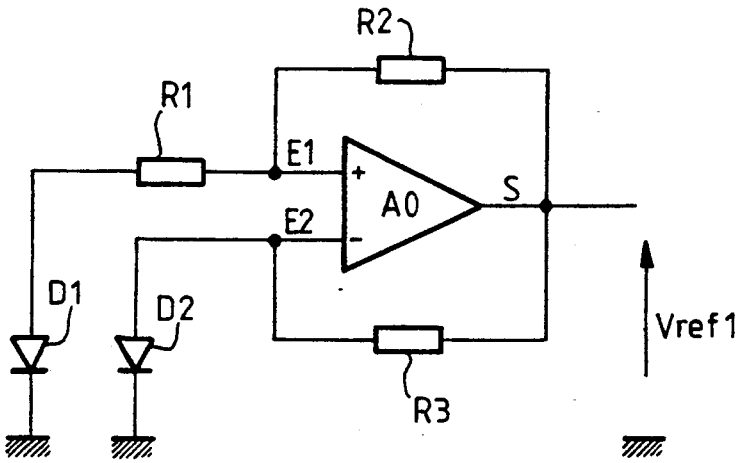
FIG_1
PRIOR ART
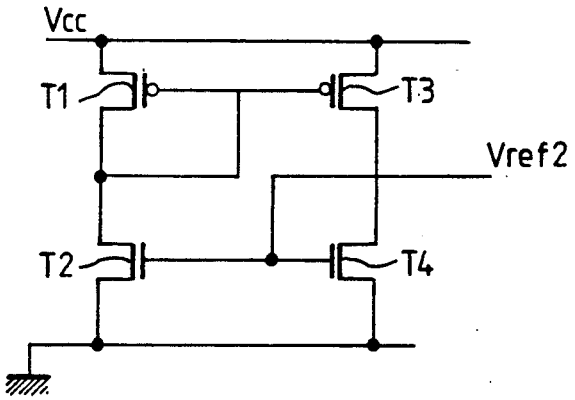
FIG_2
PRIOR ART
FIG_3
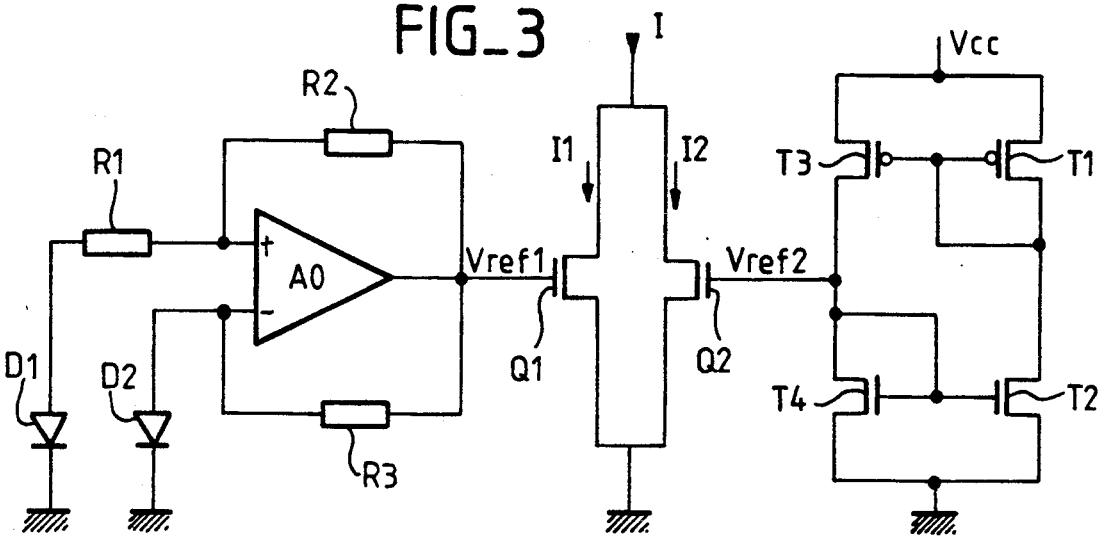

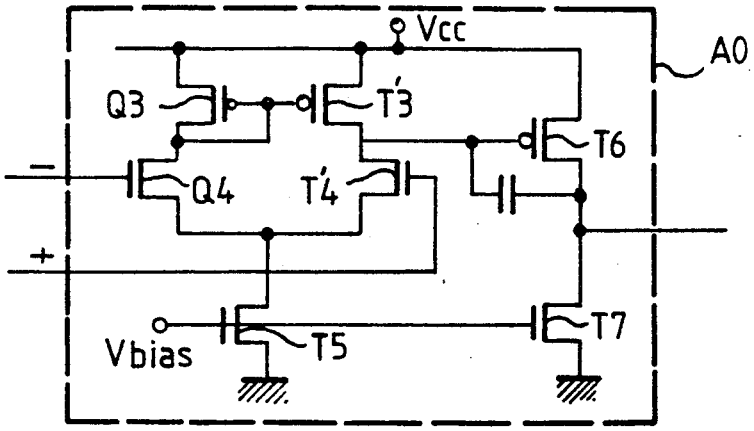
FIG_4
PRIOR ART
FIG_5
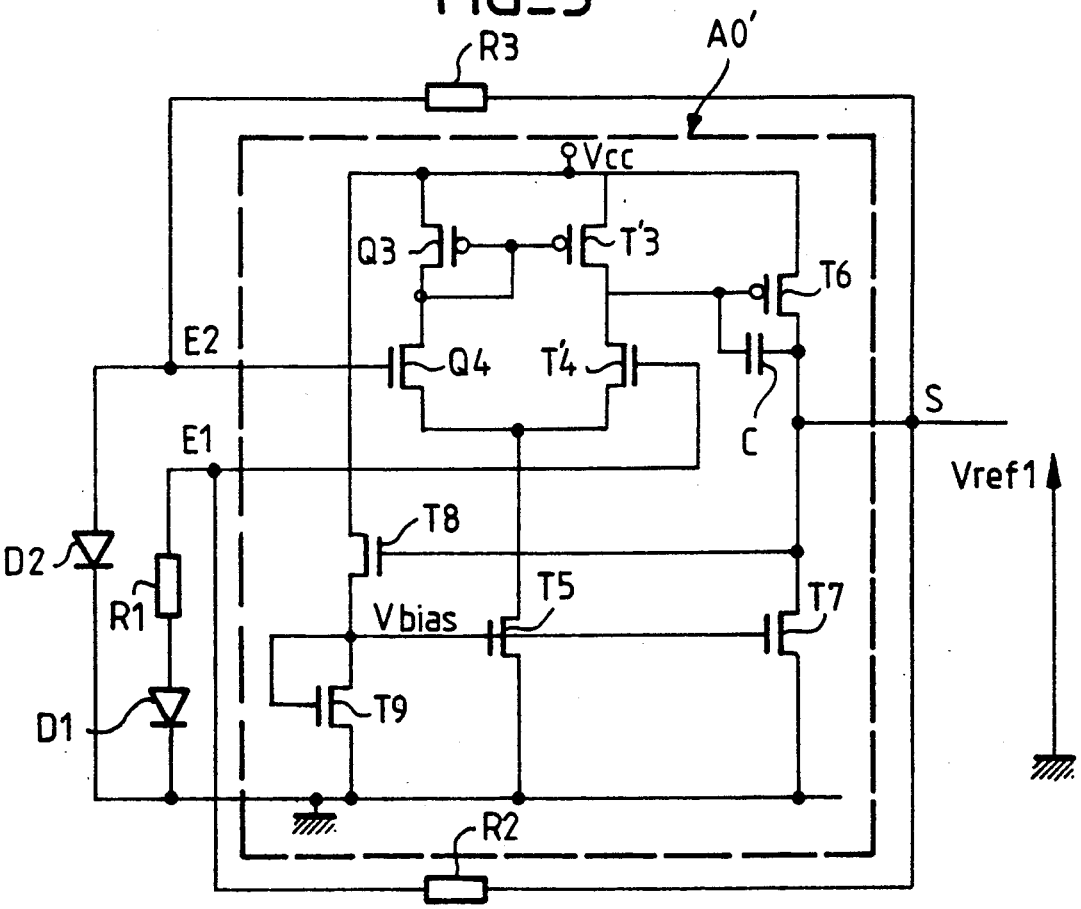

CURRENT SOURCE WITH LOW TEMPERATURE COEFFICIENT

BACKGROUND OF THE INVENTION

1. Field of the Invention

The invention concerns integrated circuits and, more particularly, it concerns the way to make a constant current source, in these circuits, that is stable as a function of the temperature and the supply voltage of the integrated circuit.

2. Description of the Prior Art

There are known current sources made with a field-effect transistor and a reference voltage source that biases the gate of this transistor. The reference source voltage may be of the so-called "bandgap" type. The term "bandgap" refers to the energy interval between the valence bands and the conduction bands of a semiconductor. Sources of this type use the known relationship of dependency between this interval and the temperature to achieve compensations that make the reference voltage as stable as possible as a function of the temperature.

A voltage source of bandgap type generally has two diodes through which there flow different currents (or the same currents, but in this case the diodes are obligatorily ones with different junction surfaces) and a looped differential amplifier amplifying the voltage difference at the terminals and supplying the diodes with current.

A reference voltage source of this type is shown in FIG. 1. We shall return further below to the detailed description of this circuit.

It is of course possible to make a current source out of this voltage source, but the stability in temperature is lost during the voltage/current conversion.

There are also known references sources called "Wilson mirror" sources. A source of this kind is shown in FIG. 2. It is based on the mutual compensations of variations in characteristics of several transistors which copy one another's currents mutually.

To put it schematically, a Wilson mirror source has two parallel branches with two transistors each, and the transistors are mounted so that each branch copies the current of the other one, two transistors (each belonging to a different branch) being different in size or in threshold voltage.

Here again, although the stability obtained is often considered to be satisfactory, it is not perfect.

There are yet other reference voltage sources which do not have to be gone into in detail herein.

SUMMARY OF THE INVENTION

According to the invention, it is proposed to set up a reference current source made by the addition of two currents, one current coming from a first transistor that has its gate controlled by a "bandgap" type of reference voltage source while the other current comes from a second transistor that has its gate controlled by a "Wilson mirror" type of reference voltage source.

The invention is based on the observation that it is possible to set up, at the same time, a current that is controlled by a "bandgap" type of reference source and has a certain curve of variation as a function of the temperature, and a current that is controlled by a "Wilson mirror" type of reference source and has another type of curve of variation as a function of the temperature. By adding up the currents of these two sources, it is possible to set up a current source that is stable as a function of the temperature while, at the same time, preserving the same stability as a function of the supply voltage Vcc of the integrated circuit. It has to be noted that what makes it difficult to set up temperature-stable current sources is the extreme complexity of variations in the characteristics of the circuit as a function of the temperature once there are more than two or three transistors in the circuit: the variations in threshold voltage of each of the types of transistors of the circuit and the variations in mobility of the majority type carriers in the semiconductor have to be brought into play. These are, of course, not linear variations. Unexpectedly, it has been found that in a fairly wide range of temperature zone, from about −40° C. to +125° C., it is possible to obtain a current source that is even more stable than in the prior art, by adding together the currents of two transistors controlled by different types of voltage and having current variations of very different natures.

In one embodiment, the "bandgap" source includes an operational amplifier, with feedback by resistors and having diodes connected to its input, and an output field-effect transistor having its gate biased by the output of the operational amplifier. The Wilson type mirror source conventionally has four transistors and one output transistor. The output transistors, each of which is driven by a different voltage source, are connected with their sources linked and their drains linked, i.e. they are in parallel but are controlled by different potentials.

In one practical embodiment, it will be seen that the nominal current in the transistor controlled by the bandgap type source is greater than the current in the other transistor, by a ratio that ranges from 1.5 to 3.5, and is preferably around 2.5.

According to another characteristic of the invention, the bandgap type source is improved as follows: the operational amplifier of the bandgap voltage source has two differential branches supplied by a transistor forming a current generator, and it is proposed that this current generator should be made with a field-effect transistor, the gate of which is biased by a bias circuit that receives the reference voltage produced at the output of the bandgap reference source itself.

A certain degree of instability might have been expected in the working of the circuit since it uses its own output voltage to function. However, it is observed experimentally that this assembly is quite stable (although it requires a setting time) and that the voltage which it gives at its output is finally more stable as a function of the temperature than that given by the prior art circuits.

The bias circuit preferably includes a set of two transistors in series, one of which, connected to a supply source Vcc, receives the reference voltage while the other, which is connected by its source to the ground, has its gate connected to its drain and gives a bias voltage at its drain for the current source of the operational amplifier.

BRIEF DESCRIPTION OF THE DRAWINGS

Other characteristics and advantages of the invention will appear from the following detailed description, made with reference to the appended drawings, of, which:

FIG. 1 shows a bandgap type voltage source;

FIG. 2 shows a "Wilson mirror" type of reference source;

FIG. 3 shows a current source according to the invention;

FIG. 4 shows an operational amplifier used in the circuit of FIG. 3;

FIG. 5 shows an improvement in the bandgap type voltage source used in the invention.

DETAILED DESCRIPTION OF THE INVENTION

In FIG. 1, the "bandgap" type of voltage source includes an operational amplifier AO having a first input E1, a second input E2 and an output S. The input E1 is connected through a resistor R1, in series with a diode D1, to a electrical ground. The input E2 is connected through a diode D2 to the ground. A feedback resistor R2 connects the output S to the input E1. A resistor R3 connects the output S to the input E2. The output of the amplifier delivers a reference voltage Vref1 which is stable in temperature and stable as a function of the supply Vcc of the integrated circuit incorporating this reference source. With the current technologies used to make CMOS circuits on silicon, the reference voltage obtained automatically at output of the amplifier AO is, for example, 1.255 volts.

This stability of the output voltage is based on an appropriate choice of the junction surfaces of the two diodes and of the currents flowing in these diodes. The reference voltage Vref1 obtained at output of the amplifier is the sum of the characteristic bend voltage (i.e. the voltage at the bend in the characteristic curve) Vbe2 of the diode D2 and of a term which is Vf.R2/R1 where Vf is a voltage that is the product of a standard "bandgap" voltage Vt (with Vt=kT/q) and a term which is the natural logarithm of the ratio R2.S1/R3.S2, and S1 and S2 are the junction surfaces of the two diodes D1 and D2.

The principle by which the goal is achieved is simple: it is possible in practice to compute or measure the way in which Vbe2 varies with the temperature (about −2.2 mV/° C). The values R1, R2, R3 and S1/S2 will be chosen so that the term Vf.R2/R1 varies exactly in the reverse direction (by +2.2 mV/° C. for example) in the desired temperature range.

It is possible, for example, to set up a reference voltage of 1.255 volts.

If this voltage source is used to control the gate of a field-effect transistor having its source at the ground, there will be a current obtained, in this output transistor, that varies as a function of the temperature. The variation is a complex one: it results from the fact that the threshold voltage of the output transistor varies with the temperature, this variation being, moreover, partially compensated for by the fact that the mobility of the carriers varies with the temperature.

FIG. 2 shows a reference voltage source or reference current source of the Wilson mirror type. It has two branches in parallel between two supply terminals which are, for example, the ground and a terminal at positive voltage Vcc. The first branch has a first P channel MOS transistor T1 in series with a second N channel transistor T2. The second branch has a third P channel transistor T3 in series with a fourth N channel transistor T4. The first and fourth transistors are mounted as resistors, with their drains connected to their gates. The third and second transistors copy, respectively, the currents in the first and fourth transistors. It will be recalled that a current copying assembly is an assembly in which the transistor that copies the current of another transistor has its gate and its source connected respectively to the gate and source of this other transistor. The current is copied with a proportionality factor that is the ratio between the geometries of the transistors. The stable reference voltage Vref2 generated by this assembly is picked up at the junction point of the drains of the transistors of a branch, herein at the junction point of the transistors T3 and T4. Preferably, the transistors T2 and T4 have different threshold voltages: this is obtained by a difference in the doping of their channels.

The circuit according to the invention is shown in FIG. 3. It has two parallel-mounted transistors Q1 and Q2, i.e. transistors having their sources connected together to the ground and their drains connected together. The gates are controlled separately, one by the voltage Vref1 coming from a reference voltage source of the type shown in FIG. 1 and the other by the reference voltage Vref2 coming from a reference voltage source of the type shown in FIG. 2

In the example shown, the transistors Q1 and Q2 are N channel transistors, to set up a source of current I drained towards the ground. But they could also be P channel transistors, having their source connected to Vcc and their drains connected to ground to set up a source of current I drained from the supply voltage Vcc.

The output current I of the current source thus described is, in both cases, taken at the connected drains of the two transistors Q1 and Q2. It is the sum of the current I1 in the transistor Q1 and the current I2 in the transistor Q2.

The two transistors Q1 and Q2 do not have the same size in principle. Their respective sizes depend first of all on the differences in the value of the reference voltages Vref1 and Vref2. These values themselves depend on the values of transistor resistances and junction surfaces or geometries. They then depend on the way in which the currents in each of the transistors Q21 and Q2 vary with the temperature.

Of course, it is not possible to give any rule of direct computation for the choice of the dimensions of Q1 and Q2 since these dimensions will depend on the technology used and since many choices are possible even for a single technology. However, an explanation is given below of how to proceed in practice to set up a current source according to the invention without any difficulty.

First of all, the components of the circuit giving Vref1 are chosen. The reference voltage obtained Vref1 is the sum of a characteristic bend voltage Vbe2 of the diode D2 and a voltage which is the well-known bandgap voltage (generally represented by the algebraic form kT/q where k and q are physical constants and T is the absolute temperature), this voltage being multiplied by a multiplier factor K.

The multiplier factor K is equal to R2/R1 multiplied by the natural logarithm having the following expression: R2.S1/R3.S2 where S1 and S2 are the junction surfaces of the diodes D1 and D2; R1, R2, R3 are the values of the resistances.

In the same way, Vref2 can be chosen in computing this voltage by standard current and voltage equations, taking account of the fact that the current in a MOS transistor is proportional to the square of the difference between its gate-source voltage and its threshold voltage. The technology gives the threshold voltage of the different transistors. The current is also proportional to the mobility of the carriers, to the capacity of the gate and to the geometry of the transistor (the ratio W/L between the width and length of the channel).

Starting with Vref1, by means of mathematical simulations conventionally used in the designing of microelectronic circuits, it is possible to determine the nature of the curve of variation in temperature of the current generated in the transistor Q1 and of the curve of variation in temperature of the current in the transistor Q2. These curves are very different. If the current in the transistor Q1 is I1 at a mean ambient temperature (for example 25° C.), and if the current in Q2 is I2 at the same mean ambient temperature then the variations in I1 and I2 may be assessed as a function of the temperature, and then a ratio between I1 and I2 may be chosen such that the sum I1+I2 varies as little as possible in a desired temperature range (for example between −40° C. and +125° C.).

For example, if the simulation gives the following variation curve for I1:

| | |
|---|---|
| 125° C. | I1 + 30% |
| 75° C. | I1 + 16% |
| 25° C. | I1 |
| −20° C. | I1 − 17% |
| −40° C. | I1 − 25% |

and if the simulation gives the following variation for I2:

| | |
|---|---|
| 125° C. | I2 − 50% |
| 75° C. | I2 − 29% |
| 25° C. | I2 |
| −20° C. | I2 + 50% |
| −40° C. | I2 + 85% |

then, it can easily be seen that I1 varies from −25% to +30% while I2 varies in the opposite direction, but to a far greater extent. To obtain as small a variation as possible of I1+I2, it will be necessary to take a basic value I2 that is considerably smaller than the basic value of I1. More precisely even, towards high temperatures (125° C.), it is possible to compensate for the variations of I1 and I2 if I1/I2 =1.66 whereas, towards the low temperatures, the temperature would be optimal if I2/I1 were equal to 3.4. Taking an intermediate value such that, for example I1/I2=2.6, we arrive at the following curve of variation of the sum I1+I2, the reference value being taken to be 25° C.:

| | |
|---|---|
| 125° C. | +7.77% |
| 75° C. | +3.5% |
| 25° C. | I1 + I2 (=3.6 times I2) |
| −20° C. | +1.6% |
| −40° C. | +5.5% |

It is clear, therefore, that for a ratio I1/I2 of 2.6 at ambient temperature, the stability of the sum I1+I2 is far greater than that of the currents I1 and I2, over a wide range of temperatures. The dimensions of the transistors Q1 and Q2 and/or the values of Vref1 and Vref2 will therefore be chosen, in this example, so as to obtain a ratio of currents of 2.6 at the mean ambient temperature. In this respect, we may recall the standard rule of computation in a MOS transistor: the current is proportional, firstly, to the ratio W/L (width to length of the channel) and, secondly, to the square of the difference between the gate-source voltage and the threshold voltage.

We have thus described the method for the setting up, in practice, of a current source which experience has shown to be very stable.

However, the stability obtained is not as perfect as might be desired, and it has been perceived that it relies partially on the characteristics of the operational amplifier which, in reality, does not have an infinite gain and an infinite input impedance.

Indeed, the amplifier will be set up, in practice, by a simple assembly with, a few transistors, such as the assembly shown in FIG. 4.

In this example, made by CMOS technology, the operational amplifier has an assembly with two differential branches (Q3, Q4, T'3, T'4) supplied by a constant current source (transistor T5, the gate of which is biased by a bias voltage Vbias), and finally an output stage T6, T7.

According to the invention, it is proposed that this current source which supplies the differential branches should be made by means of a field-effect transistor, the gate of which is biased by a bias circuit that receives the reference voltage produced at the output of, the bandgap reference source itself.

FIG. 5 shows the modified bandgap type reference source according to the invention.

The circuit of FIG. 5 includes an operational amplifier AO' similar to that of FIG. 4 except for the source of current that supplies its two differential branches.

The amplifier AO' is, moreover, connected in a circuit that is identical, in this example, to that of FIG. 1: a non-inverter input E1 of the amplifier is connected by a resistor R1 and a diode D1 to the ground. An inverter input E2 is connected by a diode D2 to the ground. The non-inverter input E1 is connected to the outputs of the amplifier by a feedback resistor R2; the inverter input E2 is connected to the output by a feedback resistor R3. The outputs of the circuit is the output S of the operational amplifier, and it is at this output that there is provided a reference voltage Vref1 which is stable as a function of the temperature and the supply voltage Vcc of the circuit.

In the example shown, the operational amplifier has two differential branches supplied by a common current source, and an output stage.

The current source includes the N channel transistor T5 and a bias circuit of this transistor T5. The first differential branch, connected between the drain of the transistor T5 and the general supply voltage Vcc of the circuit, includes a set of two transistors in series Q3 and Q4. Q3 is a P channel transistor connected by its source to Vcc and having its drain connected to its gate. Q4 is an N channel transistor having its source connected to the current source T5.

The second differential branch, connected in parallel with the first one, includes a set of two transistors in series T'3 and T'4. T'3 is a P channel transistor connected by its source to Vcc. T'4 is an N channel transistor having its source connected to T5.

The input E1 is formed by the gate of T'4; the input E2 is formed by the gate of Q4.

The output stage includes a P channel transistor T6 and an N channel transistor T7 in series between Vcc and the ground. T6 has its gate connected to the junction of the drains of T'3 and T'4. It also has its gate connected by a capacitor C to its drain (for conventional reasons of stabilization). T7 has its drain connected to that of T6 and its gate receives a bias voltage which is preferably the same as the bias voltage used for the gate of T5. The output S of the amplifier AO' is the common drain of the transistors T6 and T7 of the output stage.

According to the invention, it is provided that the current source supplying the differential branches of the amplifier is biased by a bias circuit which uses the output voltage Vref1 of the amplifier.

In the preferred example shown, in FIG. 5, the bias circuit has two N channel transistors T8 and T9 in series between the supply voltage Vcc and the ground. T8 has its drain connected to Vcc, its source connected to the drain of T9 and its gate connected to the output S of the operational amplifier. T9 has its source connected to the ground and its gate connected to its drain. The bias voltage Vbias, applied to the gate of the transistor T5, is picked up at the junction point of the transistors T8 and T9.

The transistor T8 is preferably a transistor, the channel length L of which is far greater than its width (i.e. it is a long transistor), for example in a ratio of 100 to 3, so that it obligatorily remains in a state of saturation (with a small variation in its drain current, even for a high variation in its drain/source voltage). The transistor T9 is, on the contrary, a "short" transistor, having a far greater width to length ratio (for example a ratio of one), with a channel width in the same range as that of T8.

We may summarize the performance characteristics of the voltage source according to the invention here below, in a practical example: the following table (which is a double entry table) represents the variation in reference voltage as a function of the temperature of the supply voltage Vcc for the assembly according to the invention as described above. The nominal reference voltage, for 25° C. and Vcc=5 volts, is 1.256 volts in this example.

| T° C. | −40° C. | 25° C. | 125° C. |
|---|---|---|---|
| VCC: | | | |
| 4 volts | 1.252 v | 1.256 v | 1.256 v |
| 5 volts | 1.252 v | 1.256 v | 1.256 v |
| 6 volts | 1.252 v | 1.256 v | 1.257 v |

It can be seen that the reference voltage obtained has very great stability as a function of the temperature and of the voltage Vcc.

The combination with the Wilson source is all the more efficient.

What is claimed is:

1. A reference current source made by the addition of two currents, one current coming from a first transistor that has its gate controlled by a "bandgap" type reference voltage source while the other current comes from a second transistor that has its gate controlled by a "Wilson mirror" type reference voltage source.

2. A reference current source according to claim 1, wherein the bandgap type reference voltage source includes an operational amplifier having an inverter input and a non-inverter input, with two diodes connected to these inputs and feedback and input resistors for the amplifier.

3. A reference current source according to claim 1, wherein said reference current source is in the form of an integrated circuit, wherein the bandgap type reference voltage source includes an operational amplifier having first and second inputs and an output; first and second diodes; first and second feedback resistors; and an input resistor; with said first diode and said first input resistor being connected between an electrical ground and said first input, said second diode being connected between an electrical ground and said second input, said first feedback resistor being connected between said output and said first input, and said second feedback resistor being connected between said output and said second input.

4. A reference current source according to one of the claims 1 to 3, wherein the Wilson mirror type reference voltage source includes two branches in parallel between two supply terminals, the first branch including a third transistor in series with a fourth transistor, the second branch including a fifth transistor in series with a sixth transistor, said third and fifth transistors being P channel transistors, said fourth and sixth transistors being N channel transistors, the fourth and fifth transistors being mounted so as to respectively copy the currents of the sixth and third transistors.

5. A reference current source according to any of the claims 1 to 3, wherein the first and second transistors, the gates of which are controlled by the reference voltage sources, have geometries chosen in relation to the voltage values delivered by the reference voltage sources to minimize the variation of the overall current from the current source as a function of the temperature.

6. A reference current source according to claim 5, wherein the current in the transistor controlled by the bandgap type reference voltage source has a nominal value which is about 2.5 times greater than the nominal value of the current in the transistor controlled by the Wilson mirror type reference voltage source.

7. A reference current source according to claim 3, wherein the operational amplifier includes two differential branches supplied by a constant current source, said constant current source including a transistor and a bias circuit, said bias circuit being connected to said output of said operational amplifier and to the gate of this constant current source transistor, wherein said bias circuit uses the voltage at said output of the operational amplifier to produce a bias voltage at the gate of the constant current source transistor.

8. A reference current source according to claim 7, wherein the bias circuit includes two transistors connected in series, the gate of one of the bias circuit transistors being connected to said output of said operational amplifier, the gate and drain of the other bias circuit transistor being connected together, and the junction point of the two bias circuit transistors being connected to the gate of the constant current source transistor.

9. A reference current source according to claim 8, wherein the two transistors of the bias circuit are N channel transistors, the bias circuit transistor having its gate connected to said output of the operational amplifier also having its drain connected to a supply voltage, and the other bias circuit transistor having its source at an electrical ground.

10. A reference current source according to claim 9, wherein the bias circuit transistor having its gate connected to said output of the operational amplifier is a transistor with a long channel and the other transistor of the bias circuit is a transistor with a short channel.

11. A reference current source according to claim 1 wherein the characteristics of the first and second transistors, the bandgap type reference voltage source, and the Wilson mirror type reference voltage source are such that the ratio of the nominal current in the first transistor to the nominal current in the second transistor is in the range of 1.5 to 3.5.

12. A reference current source according to claim 4, wherein the gates of said third and fifth transistors are connected to the junction between said third and fourth transistors, wherein the gates of said fourth and sixth transistors are connected to the junction between said fifth and sixth transistors, and wherein the gate of said second transistor is connected to the junction between said fifth and sixth transistors.

13. A reference current source according to claim 1 wherein said first and second transistors are N channel transistors, the sources of said first and second transistors being connected together and to an electrical ground, and the drains of said first and second transistors being connected together.

14. A reference current source according to claim 1 wherein said first and second transistors are P channel transistors, the sources of said first and second transistors being connected together and to a supply voltage source, and the drains of said first and second transistors being connected together.

* * * * *